US009676201B2

(12) United States Patent
Omuro et al.

(10) Patent No.: US 9,676,201 B2
(45) Date of Patent: Jun. 13, 2017

(54) LIQUID CONTAINER AND LIQUID EJECTION APPARATUS

(71) Applicant: SEIKO EPSON CORPORATION, Tokyo (JP)

(72) Inventors: Makoto Omuro, Matsumoto (JP); Yoshiyuki Tanaka, Matsumoto (JP); Shoichi Ishizawa, Asahi-mura (JP); Koji Kawai, Shiojiri (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

(21) Appl. No.: 15/071,550

(22) Filed: Mar. 16, 2016

(65) Prior Publication Data

US 2016/0271962 A1 Sep. 22, 2016

(30) Foreign Application Priority Data

Mar. 17, 2015 (JP) ..... 2015-053045

(51) Int. Cl.
*B41J 2/175* (2006.01)
*B41J 29/13* (2006.01)

(52) U.S. Cl.
CPC ..... *B41J 2/17553* (2013.01); *B41J 2/1752* (2013.01); *B41J 2/17509* (2013.01); *B41J 2/17513* (2013.01); *B41J 2/17523* (2013.01); *B41J 29/13* (2013.01)

(58) Field of Classification Search
None
See application file for complete search history.

(56) References Cited

U.S. PATENT DOCUMENTS

2012/0125481 A1 5/2012 Matsumoto et al.
2014/0043408 A1* 2/2014 Kudo ..... B41J 2/175 347/86

FOREIGN PATENT DOCUMENTS

| | | | |
|---|---|---|---|
| JP | 8-187873 A | | 7/1996 |
| JP | 2002-337878 A | | 11/2002 |
| JP | 2004-009488 A | | 1/2004 |
| JP | 2004-142325 A | | 5/2004 |
| JP | 2006281861 A | * | 10/2006 |
| JP | 2012-106363 A | | 6/2012 |
| JP | 2012-116515 A | | 6/2012 |

OTHER PUBLICATIONS

Machine Translation of Yasui, Chikara "Tank With Graduation for Liquid Volume Detection" JP 2006281861A, Oct. 19, 2006, Paragraphs 0016, 0017, and 0019, Figs. 1A-1B.*

* cited by examiner

*Primary Examiner* — Lisa M Solomon
(74) *Attorney, Agent, or Firm* — Foley & Lardner LLP

(57) ABSTRACT

Provided is an ink tank including: a wall portion that constitutes a liquid containing portion for containing ink; a liquid injection port for injecting the ink into the liquid containing portion, the liquid injection port being provided above the liquid containing portion; and a liquid visual check portion that is translucent and through which a position of a liquid surface of the ink can be visually checked from the outside, the liquid visual check portion being a part of the wall portion constituting the liquid containing portion. The liquid visual check portion has an inclined portion that inclines relative to a vertical direction.

19 Claims, 12 Drawing Sheets

LIQUID CONTAINER AND LIQUID EJECTION APPARATUS

Priority is claimed under 35 U.S.C. §119 to Japanese Application No. 2015-053045 filed on Mar. 17, 2015 which is hereby incorporated by reference in its entirety.

BACKGROUND

1. Technical Field

The present invention relates to liquid containers and liquid ejection apparatuses.

2. Related Art

Hitherto, inkjet printers are known as an example of liquid ejection apparatuses. Inkjet printers can print on print mediums by discharging ink, which is an example of liquid, from a liquid ejection head onto printing mediums such as printing paper. Regarding such inkjet printers, a configuration in which ink stored in a tank, which is an example of a liquid container, is supplied to the liquid ejection head has been hitherto known. An injection port for supplying ink is provided in a tank. A user inserts a supply port of an ink bottle (liquid supply container) that contains the ink into the injection port, and supplies the ink to the tank (e.g., see JP-A-2012-106363). If a larger amount of the ink than the amount that can be contained in the tank is injected, the ink overflows from the injection port. For this reason, a translucent wall portion in which the position of the liquid surface of the ink can be visually checked is provided in a side face of this kind of tank, and the user injects the ink into the tank from the ink bottle while visually checking the position of the liquid surface of the ink in the tank from the outside through this wall portion.

However, if the wall portion for visually checking the position of the liquid surface of the ink is provided in the side face of the tank, the user needs to inject the ink into the tank from the ink bottle while assuming a posture in which the upper body is deeply bent forward or laterally inclined and visually checking the position of the liquid surface of the ink in the tank from a direction in which the user opposes the side face of the tank, i.e., the horizontal direction. That is to say, there is a problem in that an injecting operation is not easy because, when injecting the ink into the tank from the ink bottle, the user cannot inject the ink while assuming a natural posture. In addition, when injecting the ink into the tank from the ink bottle, there are cases where the ink attached to an inner circumferential face of the injection port moves along an inner wall face of the tank and is attached to the inside of the wall portion for visually checking the position of the liquid surface of the ink. Therefore, there is a problem in a decrease in the visibility from the outside of the wall portion for visually checking the position of the liquid surface of the ink.

SUMMARY

The invention has been made in order to solve at least some of the foregoing problems, and can be achieved as the following modes or application examples.

APPLICATION EXAMPLE 1

A liquid container including: a wall portion that forms a liquid containing portion for containing liquid; a liquid injection port for injecting the liquid into the liquid containing portion, the liquid injection port being provided above the liquid containing portion; and a liquid visual check portion that is translucent and through which a position of a liquid surface of the liquid can be visually checked from the outside, the liquid visual check portion being a part of the wall portion that forms the liquid containing portion, wherein the liquid visual check portion has an inclined portion that inclines relative to a vertical direction.

According to this application example, a liquid visual check portion that is translucent and through which the position of the liquid surface of the liquid can be visually checked from the outside, and the liquid visual check portion has the inclined portion that inclines relative to the vertical direction. With this configuration, the user can visually check the inclined portion from above in the vertical direction. Therefore, the user can hold a liquid supply container and inject the liquid into the liquid container while visually checking the inclined portion from above, without deeply bending forward or laterally inclining the upper body. Accordingly, when injecting the liquid into the liquid container from the liquid supply container, the user can inject the liquid while assuming a natural posture, and accordingly, an injecting operation can be easily performed.

APPLICATION EXAMPLE 2

The above-described liquid container wherein a direction in which the liquid injection port and the inclined portion are arranged side-by-side as viewed from the vertical direction is an inclining direction of the inclined portion.

According to this application example, when the liquid is injected into the liquid container while inclining the liquid supply container in a direction that intersects the inclining direction of the inclined portion, the inclined portion is not hidden by the liquid supply container.

APPLICATION EXAMPLE 3

The above-described liquid container wherein a direction in which the liquid injection port and the inclined portion are arranged side-by-side as viewed from the vertical direction is a direction that intersects an inclining direction of the inclined portion.

According to this application example, when the liquid is injected into the liquid container while inclining the liquid supply container in the inclining direction of the inclined portion, the inclined portion is not hidden by the liquid supply container.

APPLICATION EXAMPLE 4

The above-described liquid container wherein an inclining direction of the inclined portion is a direction in which a plurality of the liquid containers are arranged side-by-side.

According to this application example, the inclining portion is highly visible from the direction in which the plurality of liquid containers are arranged side-by-side.

APPLICATION EXAMPLE 5

The above-described liquid container wherein an inclining direction of the inclined portion is a direction that intersects a direction in which a plurality of the liquid containers are arranged side-by-side.

According to this application example, the inclining portion is highly visible from a direction that intersects the direction in which the plurality of liquid containers are arranged side-by-side.

APPLICATION EXAMPLE 6

The above-described liquid container wherein the inclined portion is formed in a vertically upper part of the wall portion.

According to this application example, the user can recognize, through the inclined portion, the position of the liquid surface of the maximum amount of the liquid that is to be appropriately contained. Accordingly, the user can stop the liquid injecting operation and prevent the liquid from overflowing from the liquid injection port.

APPLICATION EXAMPLE 7

The above-described liquid container wherein an index that can be compared with the position of the liquid surface of the liquid is formed in the inclined portion.

According to this application example, the position of the liquid surface can be easily recognized by comparing the position of the liquid surface with the index. If the position of the index indicates the position of the liquid surface of the maximum amount of the liquid that is to be appropriately contained, the user who injects the liquid can refer to the index to stop the liquid injecting operation, and prevent the liquid from overflowing from the liquid injection port.

APPLICATION EXAMPLE 8

The above-described liquid container wherein in the vertical direction, a position of an upper end portion of the inclined portion is above a position of a lower end portion of the liquid injection port.

According to this application example, when the liquid is supplied from the liquid injection port, the liquid does not flow to the inclined portion side from the liquid injection port within the liquid container. Therefore, since the liquid is not attached to the inclined portion, the visibility of the inclined portion from the outside can be favorably maintained.

APPLICATION EXAMPLE 9

A liquid container including: a wall portion that forms a liquid containing portion for containing liquid; a liquid injection port for injecting the liquid into the liquid containing portion, the liquid injection port being provided above the liquid containing portion; and a liquid visual check portion that is translucent and through which a position of a liquid surface of the liquid can be visually checked from the outside, the liquid visual check portion being a part of the wall portion that forms the liquid containing portion, wherein in a vertical direction, a position of an upper end portion of the liquid visual check portion is above a position of a lower end portion of the liquid injection port.

According to this application example, in the vertical direction, the position of the upper end portion of the liquid visual check portion is above the position of the lower end portion of the liquid injection port. With this configuration, when the liquid is injected from the liquid injection port, the liquid attached to an inner circumferential face of the liquid injection port does not move along an inner wall face of the liquid container and flow to the liquid visual check portion side. Accordingly, the liquid is not attached to the liquid visual check portion, and accordingly, the visibility of the liquid visual check portion from the outside can be favorably maintained.

APPLICATION EXAMPLE 10

A liquid ejection apparatus including a liquid ejection head that injects liquid, and any of the above-describe liquid containers.

BRIEF DESCRIPTION OF THE DRAWINGS

The invention will be described with reference to the accompanying drawings, wherein like numbers reference like elements.

DESCRIPTION OF EXEMPLARY EMBODIMENTS

Embodiments of an inkjet printer (hereinafter referred to as a printer), which is an example of a liquid ejection apparatus, will be described with reference to the drawings. Note that arrows XYZ in the diagrams denote coordinate axes that are orthogonal to one another. Of the XYZ axes, the arrow direction indicates a + direction (positive direction), and the direction opposite to the arrow direction indicates a − direction (negative direction).

Embodiment 1

Figure 1:
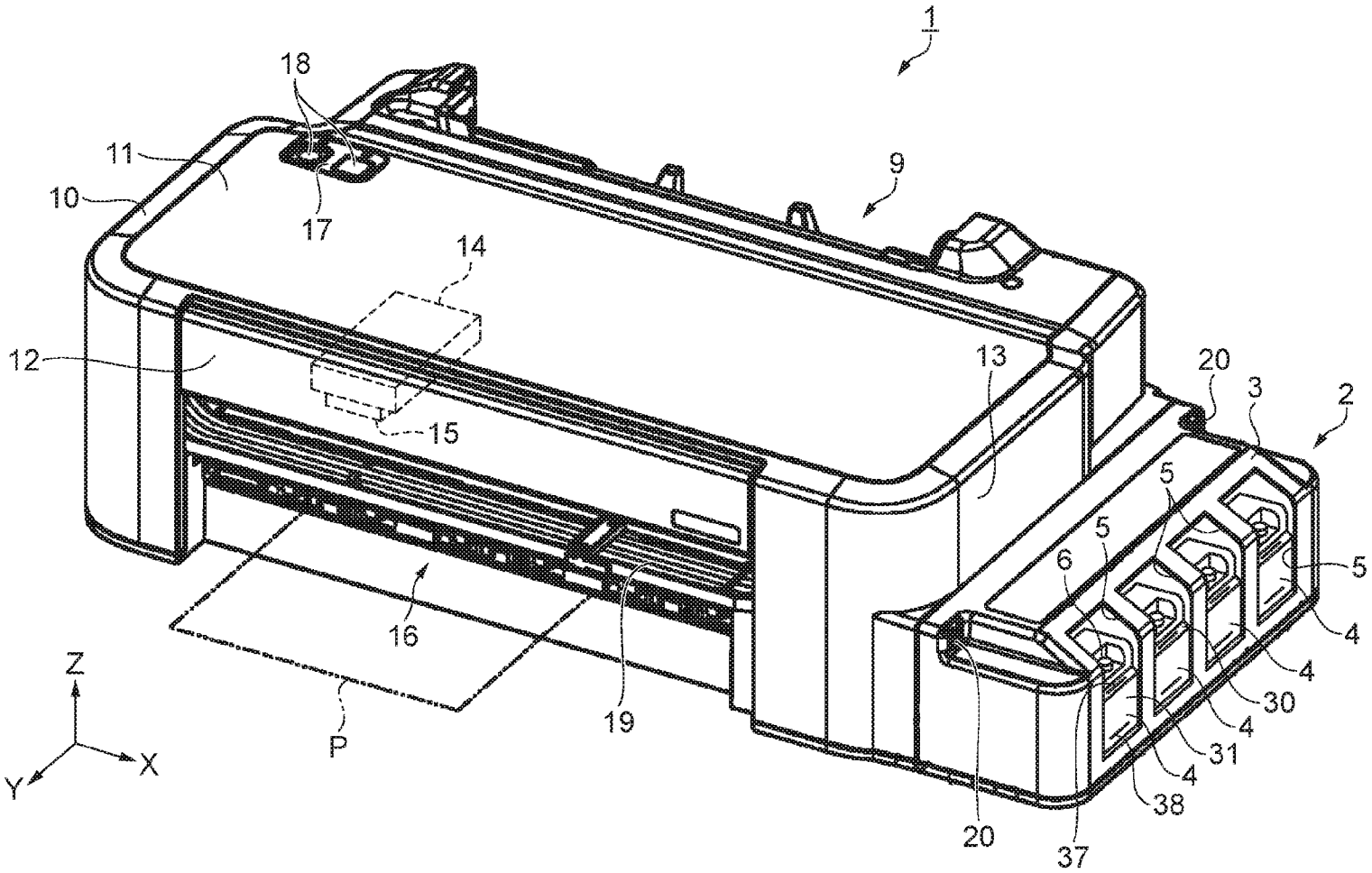
FIG. 1 is a perspective external view of an inkjet printer.

FIG. 1 is a perspective external view of a printer 1 according to Embodiment 1. The printer 1 is used in a state of being arranged in a horizontal plane defined by the X axis and the Y axis. In a state where the printer 1 is used, the Z axis is an axis that is orthogonal to the horizontal plane, and a −Z-axis direction is a vertically downward direction.

The printer 1 is constituted by an apparatus body 9 in which a liquid ejection head 15 is housed in a body case 10 and that prints on paper P, and a tank unit 2 in which ink tanks 4 are housed in a tank case 3 and that supplies ink to the liquid ejection head 15. The tank unit 2 is provided in a side face 13 of the body case 10.

A carriage 14 is fixed to an endless belt (not shown) that rotates when being driven by a carriage motor (not shown), and is guided by a guide portion (not shown), which extends in an X-axis direction, and moves back and forth in a main scanning direction (X-axis direction). The liquid ejection head 15 is provided in a lower part of the carriage 14 and moves back and forth in the main scanning direction.

In this embodiment, four ink tanks 4, which contain monochrome ink, yellow ink, magenta ink, and cyan ink, are housed in the tank case 3 while being arranged side-by-side in the Y-axis direction. Opening portions 5 are formed at four portions of the tank case 3, and a part of each ink tank 4 is exposed through the corresponding opening portion 5.

A conveyance motor and a conveyance roller pair that is driven to rotate by the conveyance motor, which are not shown, are provided in the apparatus body 9, and the paper P is held by the conveyance roller pair and conveyed in a sub-scanning direction (+Y-axis direction). The liquid ejection head 15 ejects the ink toward the paper P that is being conveyed, while moving back and forth in the main scanning direction, thereby printing on the paper P. The paper P that has been printed by the liquid ejection head 15 is discharged from a paper discharge port 16, which is provided in a lower part of the body case 10 on a front face 12 side.

An operation panel 17 is provided in an upper face 11 of the body case 10 on the back face side (i.e., in the −Y-axis direction), and operation buttons 18 for performing an operation of turning on and off the power and configuring settings of print conditions, for example, are provided in the operation panel 17.

Liquid supply tubes 19 arranged above the paper discharge port 16 are in communication with the ink tanks 4 and the liquid ejection head 15. The ink contained in the ink tanks 4 is supplied to the liquid ejection head 15 via the liquid supply tubes 19.

Figure 2:
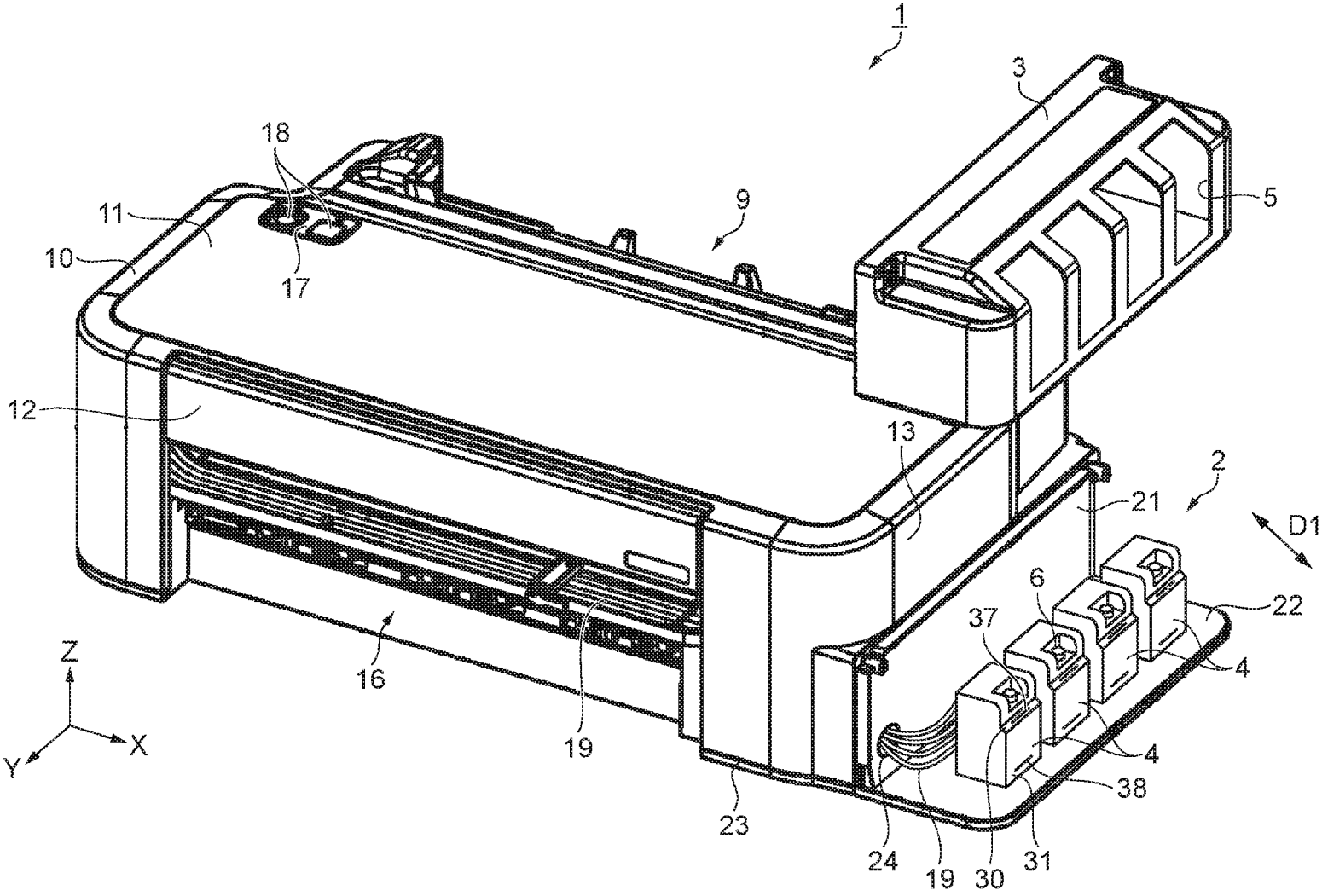
FIG. 2 is a perspective view of the inkjet printer in a state where a tank case is separate from a body case.

FIG. 2 is a perspective view of the printer 1 in a state where screws 20 in FIG. 1 have been removed, and the tank case 3 is separate from the body case 10. The four ink tanks 4 are arranged side-by-side in the Y-axis direction on a bottom wall 22 of the tank unit 2 that is located at a position in the same horizontal plane as a bottom wall 23 of the body case 10.

A wall portion 21 for installing the tank case 3 is provided in the side face 13. A through hole 24 is provided in the wall portion 21. The liquid supply tubes 19 are arranged from the ink tanks 4 toward the inside of the body case 10 through the through hole 24.

Figure 3:
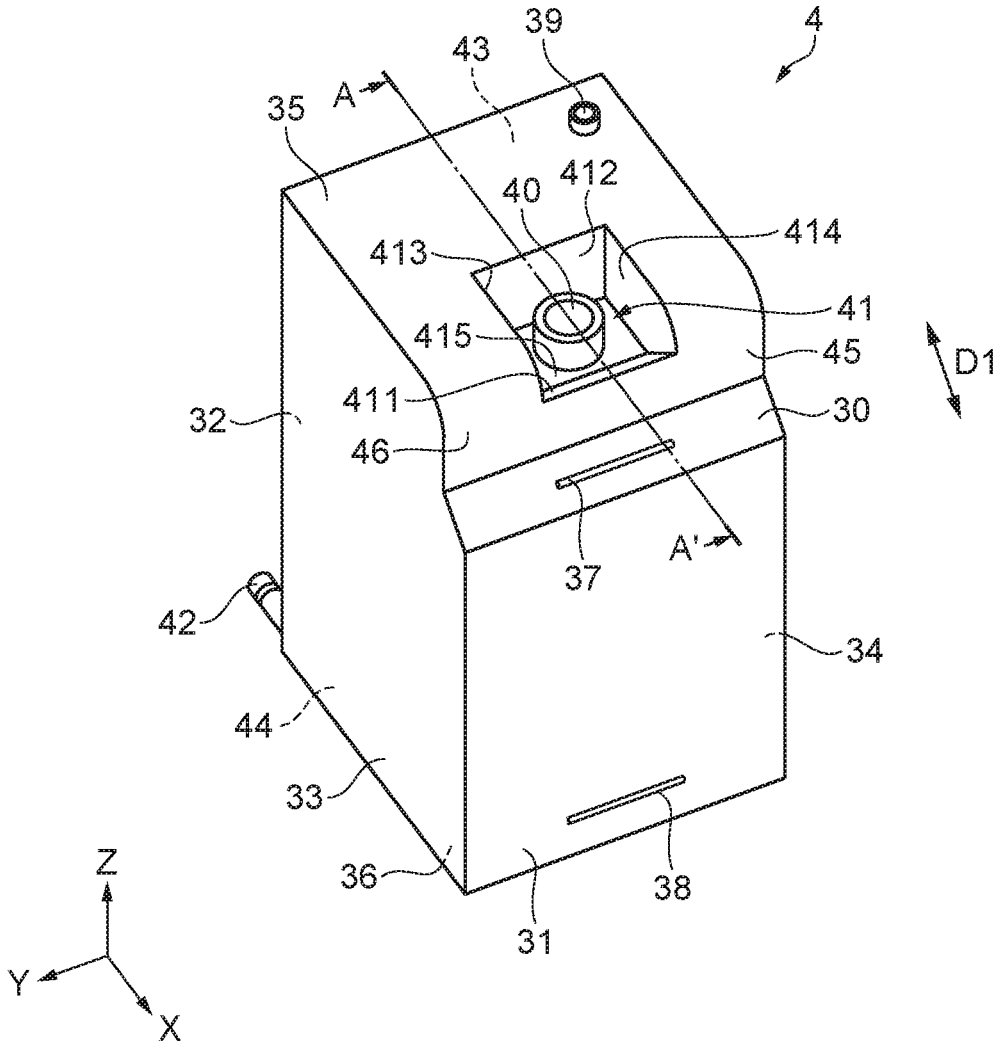
FIG. 3 is a perspective external view of an ink tank.

FIG. 3 is a perspective external view of the ink tank 4. Outer wall portions of the ink tank 4 are configured to include an upper wall 35 and a bottom wall 36 that oppose each other in the Z-axis direction, a first side wall 31 and a second side wall 32 that oppose each other in the X-axis direction, and a third side wall 33 and a fourth side wall 34 that oppose each other in the Y-axis direction. The outer shape of the ink tank 4 is substantially rectangular-parallelepiped.

A liquid injection port 40 is provided in an upper part of the ink tank 4. The liquid injection port 40 is provided in a recessed portion 41, which is recessed downward from the upper wall 35. The recessed portion 41 is formed by a bottom wall 415, and wall portions 411, 412, 413, and 414 that are connected to the bottom wall 415 so as to surround the liquid injection port 40. The recessed portion 41 functions as an ink receiving portion that receives, using the recessed portion 41, ink that has overflowed from the liquid injection port 40 or ink that has dropped off from the liquid injection port 40 when the user injects the ink, and prevents the ink from flowing downward of the recessed portion 41.

Figure 4:
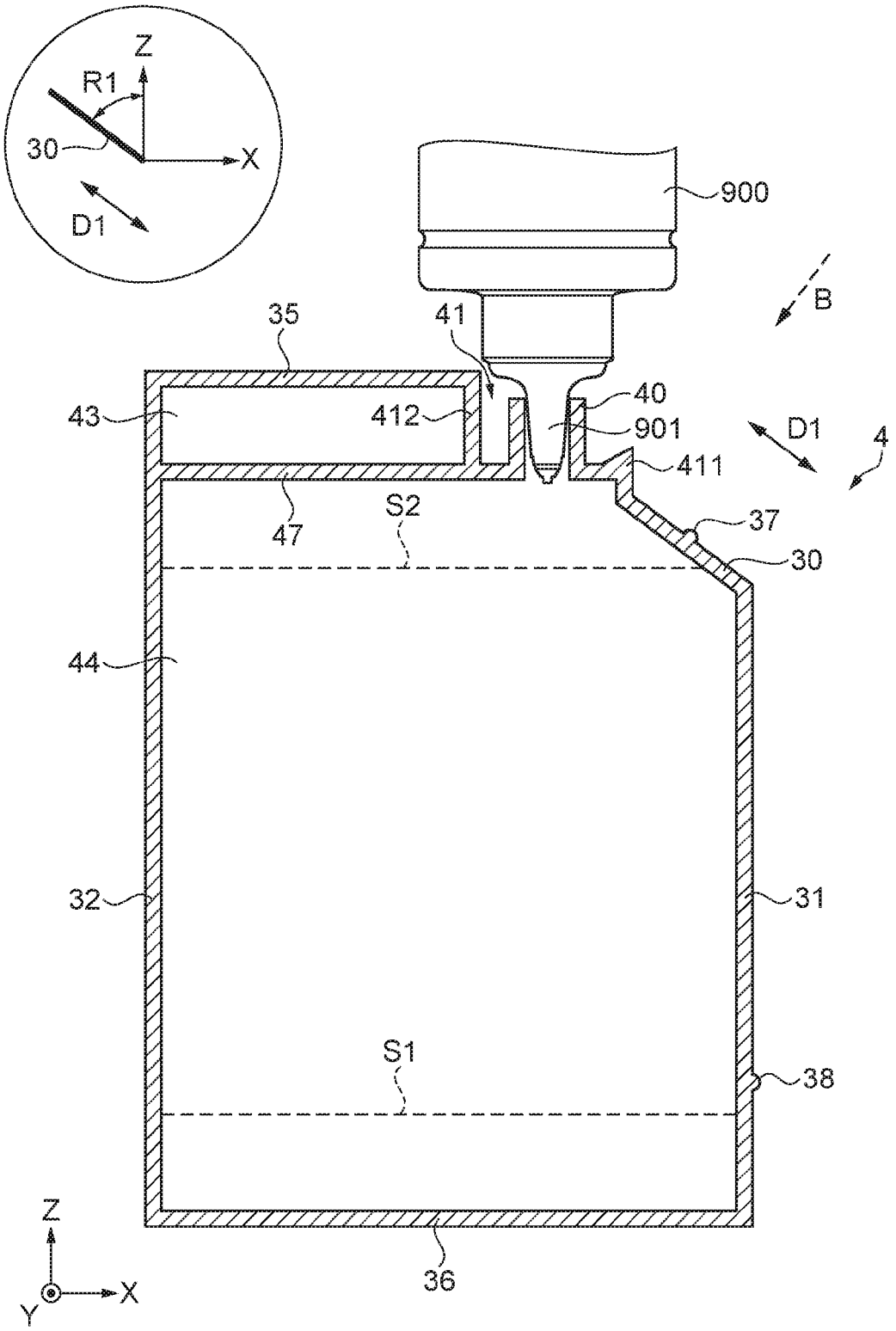
FIG. 4 is a cross-sectional view of the ink tank.

FIG. 4 is a cross-sectional view of the ink tank 4 as viewed from the arrow direction at a cross-sectional position A-A' in FIG. 3. An air containing portion 43 is formed in an upper part of the ink tank 4. The air containing portion 43 is a space area surrounded by wall portions including the upper wall 35, the wall portion 412, an upper part of the second side wall 32, an upper part of the third side wall 33, an upper part of the fourth side wall 34, a partition wall 47 that horizontally extends and partitions the space, and the like. The air containing portion 43 is in communication with an atmosphere port 39 provided in the upper wall 35 in FIG. 3, and is open to the atmosphere.

A liquid containing portion 44 is formed below the air containing portion 43. The liquid containing portion 44 is a space area surrounded by wall portions including the bottom wall 36, the first to fourth side walls 31, 32, 33, and 34, the partition wall 47, and the like. The liquid containing portion 44 is in communication with a liquid leading portion 42, which is provided in the second side wall 32 in FIG. 3. The liquid containing portion 44 is in communication with the air containing portion 43.

Wall portions 45 and 46, which are located on both sides of the wall portion 411 in the Y-axis direction and extend in the Z-axis direction, are formed at an end portion of the upper wall 35 in FIG. 3 in the +X-axis direction. An inclined portion 30 is provided between the wall portions 45, 46 and the first side wall 31 in the Z-axis direction.

As shown in FIG. 4, the inclined portion 30 is formed at a position above the liquid containing portion 44 and extends with a substantially uniform thickness. The inclined portion 30 inclines relative to the vertical direction (Z-axis direction), and is a part of wall portions that form an upper part of the liquid containing portion 44.

A diagram in a circle in the upper left part of the diagram shows the inclined portion 30 as viewed from the Y-axis direction for illustrating the inclining direction of the inclined portion 30. The inclined portion 30 inclines in a plane defined by the Z axis and the X axis. The inclined portion 30 inclines at an angle R1 relative to the vertical direction, and an inclining direction D1 of the inclined portion 30 is the X-axis direction.

The first side wall 31 and the inclined portion 30 of the ink tank 4 in FIG. 1 are exposed through the corresponding opening portion 5 of the tank case 3. The first side wall 31 and the inclined portion 30 constitute a liquid visual check portion that is formed by translucent resin. This configuration allows the user to visually check the liquid surface of the ink contained in the liquid containing portion 44 of the ink tank 4 through the first side wall 31 and the inclined portion 30.

An upper limit mark 37, which projects outward and extends in the Y-axis direction, is formed in the inclined portion 37. The upper limit mark 37 is an index indicating the position of the liquid surface of the maximum amount of ink that is to be appropriately contained in the liquid containing portion 44. A lower limit mark 38, which projects outward and extends in the Y-axis direction, is formed in a lower part of the first side wall 31. The lower limit mark 38 is an index indicating the position of the liquid surface of the minimum amount of ink that is to be appropriately contained in the liquid containing portion 44.

Upon visually checking that the position of a liquid surface S1 of the ink contained in the liquid containing portion 44 of the ink tank 4 in FIG. 4 is located below the lower limit mark 38, the user removes a cap 6 of the ink tank 4, inserts a supply port 901 of an ink bottle 900 into the liquid injection port 40 of the ink tank 4, and injects the ink contained in the ink bottle 900 into the liquid containing portion 44 of the ink tank 4.

The inclined portion 30 is provided on the upper side of the liquid containing portion 44, and inclines relative to the vertical direction. For this reason, when the position of the liquid surface of the ink rises with the injection of the ink and reaches the position of the inclined portion 30, the user can visually check the position of a liquid surface S2 of the ink through the inclined portion 30 from above in the vertical direction, as indicated by a broken line arrow B. When visually checking that the position of the liquid surface S2 of the ink has further risen and reached the position of the upper limit mark 37, the user stopes the operation of injecting the ink from the ink bottle 900.

In the opening portion 5, a transparent member through which the position of the liquid surface of the ink contained in the liquid containing portion 44 of the ink tank 4 can be visually checked may be provided. The upper limit mark 37 and the lower limit mark 38 that are formed respectively in the inclined portion 30 and the first side wall 31 may be tape-like members affixed thereto, or may be printed marks.

As described above, the ink tank 4, which is a liquid container provided in the printer 4 described in this embodiment, is provided with the wall portions, that form the liquid containing portion 44 for containing the ink serving as the liquid, the wall portions including the bottom wall 36, the first to fourth side walls 31, 32, 33, and 34, the partition wall 47, and the like. The ink tank 4 includes the liquid injection port 40 for injecting the ink into the liquid containing portion 44, the liquid injection port 40 being provided above the liquid containing portion 44, and the inclined portion 30 and the first side wall 31, each of which is a part of the wall portions that form the liquid containing portion 44 and serve as a liquid visual check portion that is translucent and through which the position of the liquid surface of the ink can be visually checked from the outside. The inclined portion 30 inclines relative to the vertical direction Z.

With this configuration, the user can visually check the inclined portion 30 from above in the vertical direction. Therefore, the user can hold the ink bottle 900 (liquid supply container) and supply the ink to the ink tank 4 while visually checking the inclined portion 30 from above, without assuming a posture in which the upper body is deeply bent forward or laterally bent. Accordingly, when injecting the ink contained in the ink bottle 900 into the ink tank 4, the user can inject the ink while assuming a natural posture, and therefore, the ink injecting operation can be easily performed.

The direction in which the liquid injection port 40 and the inclined portion 30 are arranged side-by-side as viewed from the vertical direction is the inclining direction of the inclined portion 30 (X-axis direction).

With this configuration, when the ink is injected into the ink tank 4 while inclining the ink bottle 900 in a direction (Y-axis direction) that intersects the inclining direction of the inclined portion 30, the inclined portion 30 is not hidden by the ink bottle 900.

The inclining direction of the inclined portion 30 (X-axis direction) is a direction (X-axis direction) that intersects the direction in which the plurality of ink tanks 4 are arranged side-by-side (Y-axis direction).

With this configuration, the inclined portion 30 is highly visible from the direction (X-axis direction) that intersects the direction in which the plurality of ink tanks 4 are arranged side-by-side.

The inclined portion 30 is formed in an upper part of the wall portions that form the liquid containing portion 44. With this configuration, the user can recognize, through the inclined portion 30, the position of the liquid surface of the maximum amount of the ink that is to be appropriately contained. Therefore, it is possible to stop the ink injecting operation and prevent the ink from overflowing from the liquid injection port 40.

The upper limit mark 37, which serves as an index that can be compared with the position of the liquid surface of the ink, is formed in the inclined portion 30. With this configuration, the position of the upper limit mark 37 indicates the position of the liquid surface of the maximum amount of the ink that is to be appropriately contained. Therefore, the user can stop the operation of injecting the ink from the ink bottle 900 and prevent the ink from overflowing from the liquid injection port 40.

Embodiment 2

Figure 5:
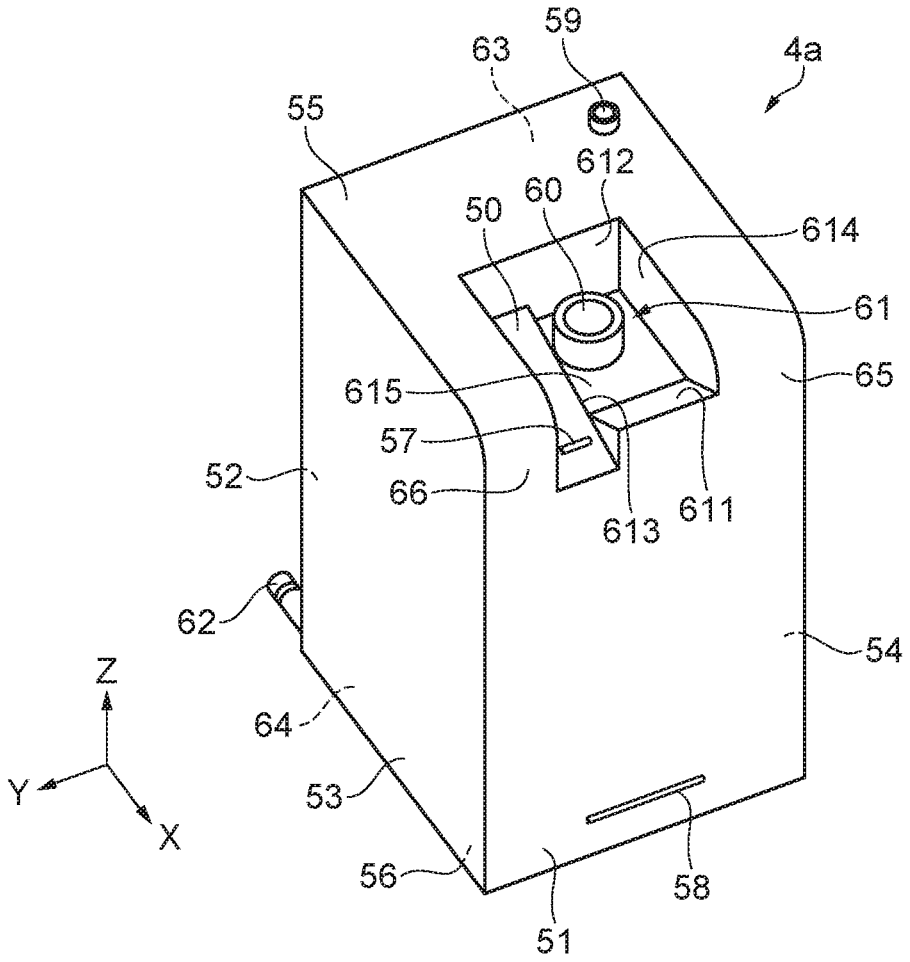
FIG. 5 is a perspective external view of an ink tank according to Embodiment 2.

Embodiment 1 has described the ink tank 4 of which the direction in which the liquid injection port 40 and the inclined portion 30 are arranged side-by-side as viewed from the vertical direction is the inclining direction of the inclined portion 30 (X-axis direction). Meanwhile, Embodiment 2 will describe an ink tank of which the direction in which a liquid injection port and an inclined portion are arranged side-by-side is a direction that intersects the inclining direction of the inclined portion. FIG. 5 is a perspective external view of an ink tank 4*a* according to Embodiment 2.

Outer wall portions of the ink tank 4*a* are configured to include an upper wall 55 and a bottom wall 56 that oppose each other in the Z-axis direction, a first side wall 51 and a second side wall 52 that oppose each other in the X-axis direction, and a third side wall 53 and a fourth side wall 54 that oppose each other in the Y-axis direction. The outer shape of the ink tank 4*a* is substantially rectangular-parallelepiped.

A liquid injection port 60 is provided in an upper part of the ink tank 4*a*. The liquid injection port 60 is provided in a recessed portion 61, which is recessed downward from the upper wall 55. The recessed portion 61 is formed by a bottom wall 615, and wall portions 611, 612, 613, and 614 that are connected to the bottom wall 615 so as to surround the liquid injection port 60.

An air containing portion 63 is formed in an upper part of the ink tank 4*a*. A liquid containing portion 64 is formed below the air containing portion 63. The air containing portion 63 and the liquid containing portion 64 are partitioned by a partition wall (not shown) that horizontally extends within the ink tank 4*a*.

The air containing portion 63 is a space area surrounded by an upper wall 55, a wall portion 612, an upper part of the second side wall 52, an upper part of the third side wall 53, an upper part of the fourth side wall 54, the partition wall for partitioning the air containing portion 63 and the liquid containing portion 64, or the like. The air containing portion 63 is in communication with an atmosphere port 59 provided in the upper wall 55, and is open to the atmosphere.

The liquid containing portion 64 is a space area surrounded by the bottom wall 56, the first to fourth side walls 51, 52, 53, and 54, the partition wall for partitioning the liquid containing portion 64 and the air containing portion 63, or the like. The liquid containing portion 64 is in communication with a liquid leading portion 62, which is provided in the second side wall 56. The liquid containing portion 64 is in communication with the air containing portion 63.

Wall portions 65 and 66, which are located on both sides of the wall portion 611 in the Y-axis direction and extend in the Z-axis direction while bending, are formed in an end portion of the upper wall 55 in the +X-axis direction. The wall portions 65 and 66 are connected to the upper wall 55 and the first side wall 51.

An inclined portion 50 is formed on the side in the +Y-axis direction relative to the liquid injection port 60. The inclined portion 50 is a wall portion that extends so as to be located at the positions of the liquid injection port 60 and the wall portion 611 in the X-axis direction, and inclines relative to the vertical direction (Z-axis direction). The inclining direction of the inclined portion 50 is the X-axis direction. The inclined portion 50 is located on the upper side of the liquid containing portion 64, and is a part of wall portions that form the liquid containing portion 64.

An upper limit mark 57, which extends in the Y-axis direction while projecting outward and serves as an index indicating the position of the liquid surface of the maximum amount of the ink that is to be appropriately contained in the liquid containing portion 64, is formed in the inclined portion 50. A lower limit mark 58, which extends in the Y-axis direction while projecting outward and serves as an index indicating the position of the liquid surface of the minimum amount of the ink that is to be appropriately contained in the liquid containing portion 64, is formed in a lower part of the first side wall 51.

A tank unit in which this kind of ink tank 4*a* is housed within the tank case 3 in FIG. 1 may be configured. The first side wall 51 and the inclined portion 50 constitute a liquid visual check portion that is formed by translucent resin. The first side wall 51 and the inclined portion 50 are exposed through the opening portion 5 of the tank case 3. For this reason, the user can visually check the liquid surface of the ink contained in the liquid containing portion 64 of the ink tank 4*a* through the first side wall 51 and the inclined portion 50.

The direction in which the liquid injection port 60 and the inclined portion 50 are arranged side-by-side in the ink tank 4*a* is a direction (Y-axis direction) that intersects the inclining direction of the inclined portion 50 (X-axis direction).

With this configuration, when the ink is injected into the ink tank 4*a* while inclining the ink bottle 900 (see FIG. 4) in the inclining direction of the inclined portion 50 (X-axis direction), the inclined portion 50 is not hidden by the ink bottle 900.

Figure 6:
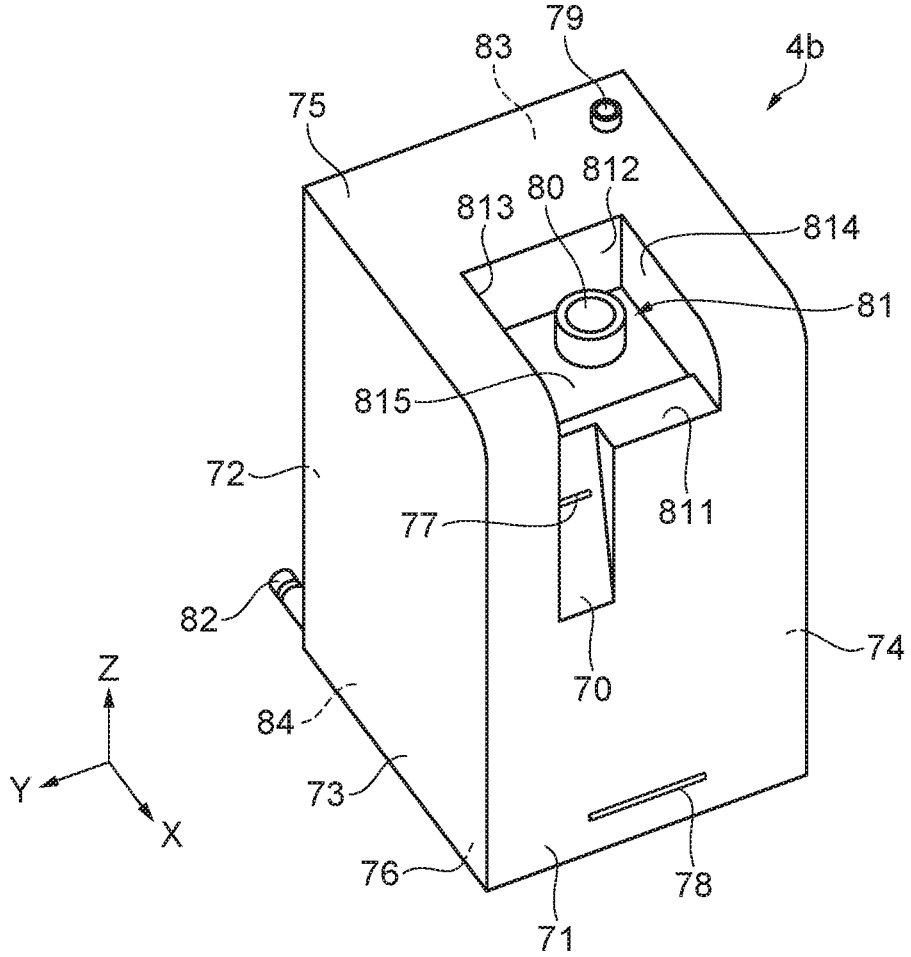
FIG. 6 is a perspective external view of the ink tank according to Embodiment 2.

The inclined portion 50 of the ink tank 4*a* in FIG. 5 is provided above the first side wall 51 in the Z-axis direction. However, as in an ink tank 4*b* shown in FIG. 6, an inclined portion 70 may be provided at a position in a first side wall 71.

Outer wall portions of the ink tank 4*b* are configured to include an upper wall 75 and a bottom wall 76 that oppose each other in the Z-axis direction, a first side wall 71 and a second side wall 72 that oppose each other in the X-axis direction, and a third side wall 73 and a fourth side wall 74 that oppose each other in the Y-axis direction. The outer shape of the ink tank 4*b* is substantially rectangular-parallelepiped.

A liquid injection port 80 is provided in an upper part of the ink tank 4*b*. The liquid injection port 80 is provided in a recessed portion 81, which is recessed downward from the upper wall 75. The recessed portion 81 is formed by a bottom wall 815, and wall portions 811, 812, 813, and 814 that are connected to the bottom wall 815 so as to surround the liquid injection port 80.

The air containing portion 83 is formed in an upper part of the ink tank 4*b*. A liquid containing portion 84 is formed below the air containing portion 83. The air containing portion 83 and the liquid containing portion 84 are partitioned by a partition wall (not shown) that horizontally extends within the ink tank 4*b*.

The air containing portion 83 is a space area surrounded by the upper wall 75, the wall portion 812, an upper part of the second side wall 72, an upper part of the third side wall 73, an upper part of the fourth side wall 74, the partition wall for partitioning the air containing portion 83 and the liquid containing portion 84, or the like. The air containing portion 83 is in communication with an atmosphere port 79 provided in the upper wall 75, and is open to the atmosphere.

The liquid containing portion 84 is a space area surrounded by the bottom wall 76, the first to fourth side walls 71, 72, 73, and 74, the partition wall for partitioning the liquid containing portion 84 and the air containing portion 83, or the like. The liquid containing portion 84 is in communication with a liquid leading portion 82, which is provided in the second side wall 72. The liquid containing portion 84 is in communication with the air containing portion 83.

The inclined portion 70 is a wall portion that extends so as to be located at the position in the first side wall 71 in the X-axis direction and inclines relative to the vertical direction (Z-axis direction). The inclined portion 70 is located on the upper side of the liquid containing portion 84, and is a part of wall portions that form the liquid containing portion 84.

An upper limit mark 77, which extends in the Y-axis direction while projecting outward and indicates the position of the liquid surface of the maximum amount of the ink that is to be appropriately contained in the liquid containing portion 84, is formed in the inclined portion 70. A lower limit mark 78, which extends in the Y-axis direction while projecting outward and indicates the position of the liquid surface of the minimum amount of the ink that is to be appropriately contained in the liquid containing portion 84, is formed in a lower part of the first side wall 71.

The first side wall 71 and the inclined portion 70 constitute a liquid visual check portion that is formed by translucent resin. The direction in which the liquid injection port 80 and the inclined portion 70 are arranged side-by-side in the ink tank 4*b* is the direction (Y-axis direction) that intersects the inclining direction of the inclined portion 70.

The inclined portion 70 of the ink tank 4*b* is provided at the position of the first side wall 71. The inclination angle of the inclined portion 70 relative to the X-axis direction is larger than the inclination angle of the inclined portion 50 in FIG. 5 relative to the X-axis direction.

Therefore, the length of the inclined portion 70 in the Z-axis direction is longer than the length of the inclined portion 50. For this reason, an area where a rising state of the liquid surface of the ink accompanying the injection of the ink can be visually checked is longer in the inclined portion 70 than in the inclined portion 50. For this reason, the time during which the user can visually check the rising of the liquid surface of the ink until the liquid surface of the ink reaches the position of the upper limit mark 77 while viewing the inclined portion 70 from above is longer. Accordingly, when the user injects the ink from the ink bottle 900, the overflow of the ink from the liquid injection port 80 can be suppressed. Other configurations of the printer in this embodiment are the same as those described in Embodiment 1.

Embodiment 3

Figure 7A:
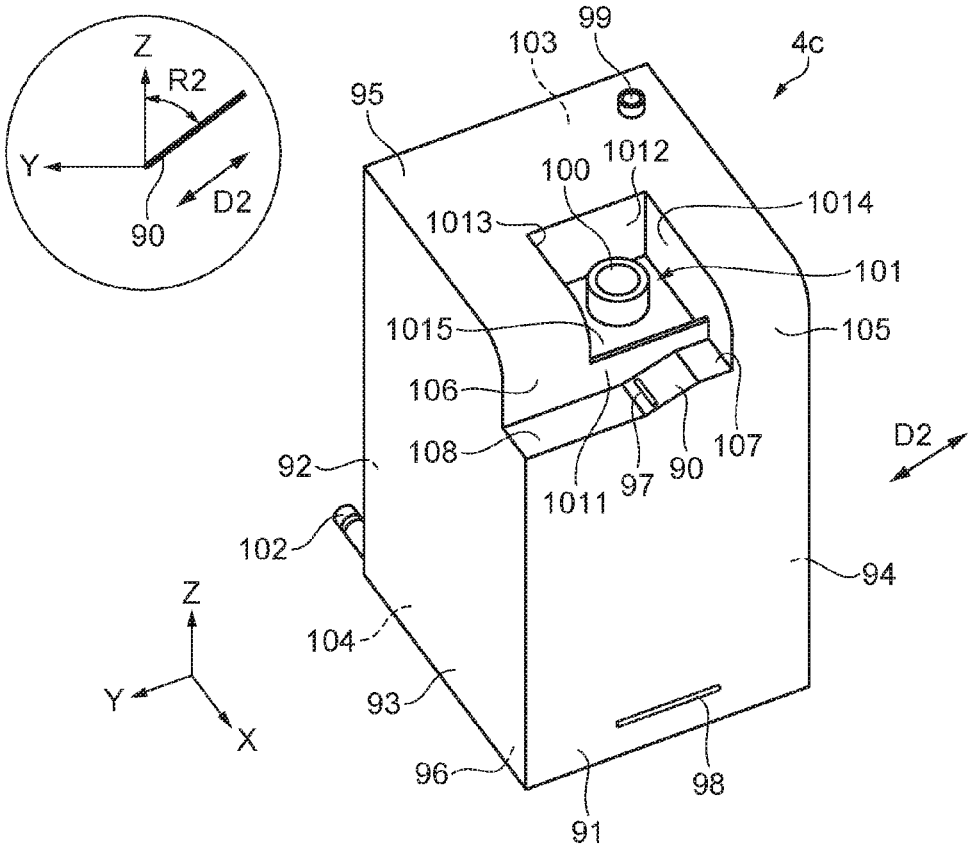
FIG. 7A is a perspective external view of an ink tank according to Embodiment 3.

In Embodiment 1 and Embodiment 2, the inclining direction of the inclined portions 30, 50, and 70 (X-axis direction) is a direction (X-axis direction) that intersects the direction in (Y-axis direction) which the four ink tanks 4, 4*a*, and 4*b* are arranged side-by-side. Embodiment 3 will describe an ink tank in which the inclining direction of an inclined portion is the direction in which a plurality of ink tanks are arranged side-by-side. FIG. 7A is a perspective external view of an ink tank 4*c* according to Embodiment 3.

Outer wall portions of the ink tank 4*c* are configured to include an upper wall 95 and a bottom wall 96 that oppose each other in the Z-axis direction, a first side wall side wall 91 and a second side wall 92 that oppose each other in the X-axis direction, and a third side wall 93 and a fourth side wall 94 that oppose each other in the Y-axis direction. The outer shape of the ink tank 4*c* is substantially rectangular-parallelepiped.

A liquid injection port 100 is provided in an upper part of the ink tank 4*c*. The liquid injection port 100 is provided in a recessed portion 101, which is recessed downward from the upper wall 95. The recessed portion 101 is formed by a bottom wall 1015, and wall portions 1011, 1012, 1013, and 1014 that are connected to the bottom wall 1015 so as to surround the liquid injection port 100.

An air containing portion 103 is formed in an upper part of the ink tank 4*c*. A liquid containing portion 104 is formed below the air containing portion 103. The air containing portion 103 and the liquid containing portion 104 are partitioned by a partition wall (not shown) that horizontally extends within the ink tank 4*c*.

The air containing portion 103 is a space area surrounded by the upper wall 95, the wall portion 1012, an upper part of the second side wall 92, an upper part of the third side wall 93, an upper part of the fourth side wall 94, a partition wall for partitioning the air containing portion 103 and the liquid containing portion 104, or the like. The air containing portion 103 is in communication with an atmosphere port 99 provided in the upper wall 95, and is open to the atmosphere.

The liquid containing portion 104 is a space area surrounded by the bottom wall 96, the first to fourth side walls 91, 92, 93, and 94, the partition wall for partitioning the liquid containing portion 104 and the air containing portion 103, or the like. The liquid containing portion 104 is in communication with a liquid leading portion 102, which is provided in the second side wall 92. The liquid containing portion 104 is in communication with the air containing portion 103.

A wall portion 105, which extends in the Z-axis direction while bending and is connected to the first side wall 91, is formed on the side in the −Y-axis direction in an end portion of the upper wall 95 in the +X-axis direction. A wall portion 106, which extends in the Z-axis direction, is formed on the side in the +Y-axis direction in the wall portion 1011 at an end portion of the upper wall 95 in the +X-axis direction.

Wall portions 107 and 108, which extend horizontally, and an inclined portion 90 are formed on the side in the +X-axis direction relative to the wall portions 106 and 1011. The wall portion 107 is provided at a position above the wall portion 108, and the inclined portion 90 is arranged between the wall portion 107 and the wall portion 108.

The inclined portion 90 is formed on the side in the +X-axis direction relative to the liquid injection port 100. The inclined portion 90 is formed at a position above the liquid containing portion 104, and extends with a substantially uniform thickness. The inclined portion 90 inclines relative to the vertical direction (Z-axis direction), and is a part of wall portions that form an upper part of the liquid containing portion 104.

The diagram in the circle in an upper left part of FIG. 7A shows the inclined portion 90 as viewed from the X-axis direction for illustrating the inclining direction of the inclined portion 90. The inclined portion 90 inclines in a plane defined by the Z axis and the Y axis. The inclined portion 90 inclines at an angle R2 relative to the vertical direction, and an inclining direction D2 of the inclined portion 90 is the Y-axis direction.

The first side wall 91 and the inclined portion 90 constitute a liquid visual check portion that is formed by translucent resin. An upper limit mark 97, which extends in the X-axis direction while projecting outward and serves as an index indicating the position of the liquid surface of the maximum amount of the ink that is to be appropriately contained in the liquid containing portion 104, is formed in the inclined portion 90. A lower limit mark 98, which extends in the Y-axis direction while projecting outward and serves as an index indicating the position of the liquid surface of the minimum amount of the ink that is to be appropriately contained in the liquid containing portion 104, is formed in a lower part of the first side wall 91.

Figure 7B:
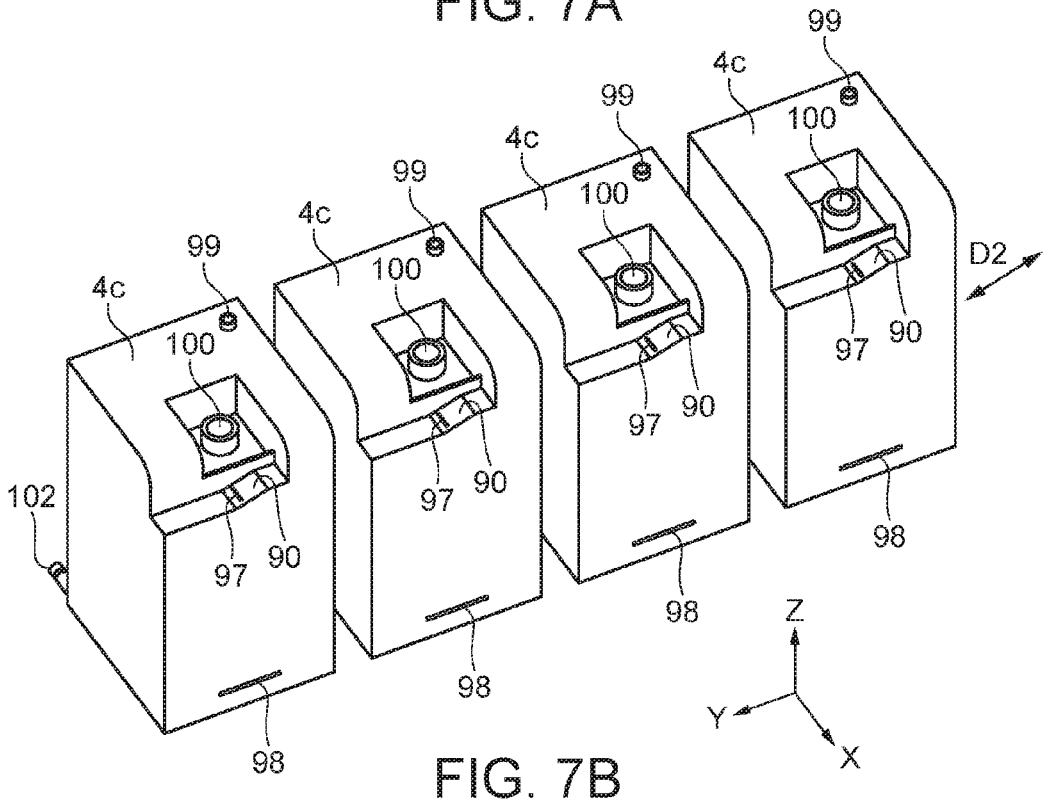
FIG. 7B is a perspective view showing a state where a plurality of ink tanks are arranged.

FIG. 7B is a perspective view showing a state where four ink tanks 4*c* are arranged side-by-side in the Y-axis direction. The four ink tanks 4*c* arranged side-by-side in the Y-axis direction may be housed in the tank case 3 in FIG. 1.

The inclining direction of the inclined portion 90 (Y-axis direction) of each ink tank 4*c* in this embodiment is the direction in which the four ink tanks 4*c* are arranged side-by-side (Y-axis direction). With this configuration, the inclined portion 90 is highly visible from the direction in which the four ink tanks 4*c* are arranged side-by-side. Other configurations of the printer in this embodiment are the same as those described in Embodiment 1.

Embodiment 4

Figure 8:
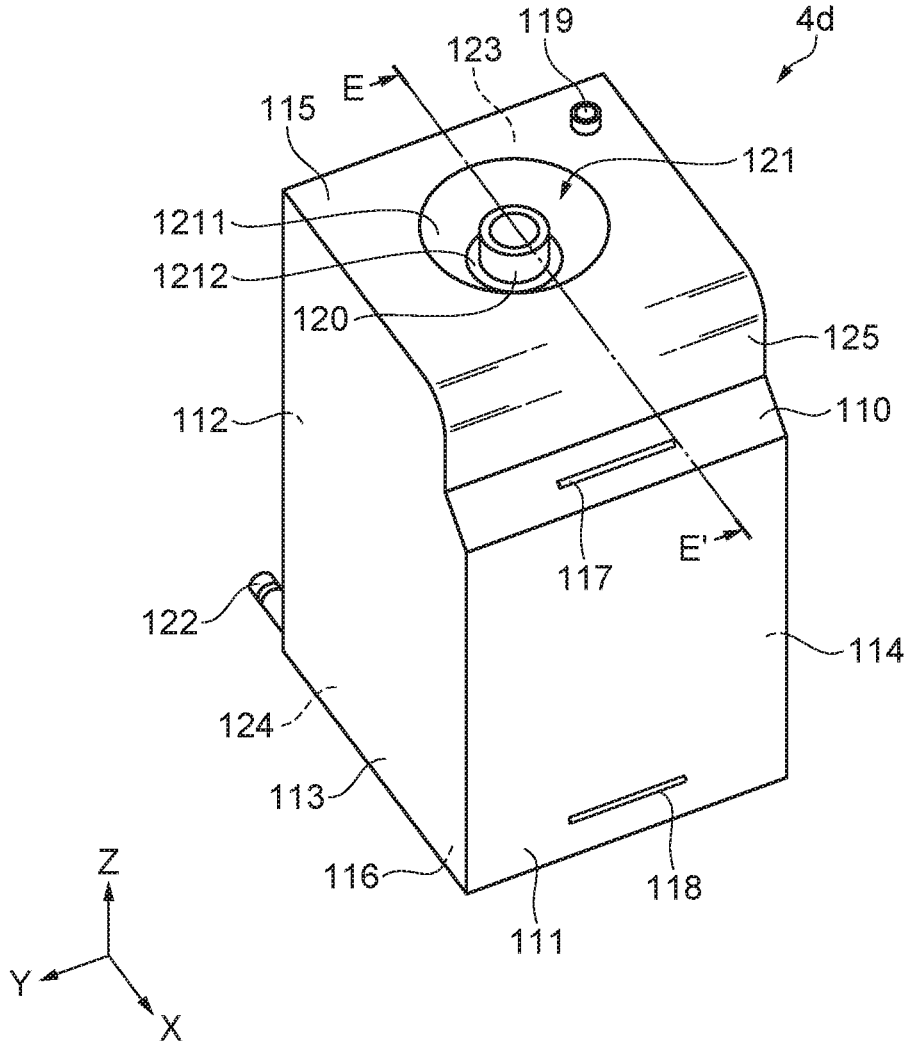
FIG. 8 is a perspective external view of an ink tank according to Embodiment 4.

Embodiment 4 will describe an ink tank in which the position of an upper end portion of the inclined portion is above the position of a lower end portion of the liquid injection port. FIG. 8 is a perspective external view of an ink tank 4*d* according to Embodiment 4.

Outer wall portions of the ink tank 4*d* are configured to include an upper wall 115 and a bottom wall 116 that oppose each other in the Z-axis direction, a first side wall 111 and a second side wall 112 that oppose each other in the X-axis direction, and a third side wall 113 and a fourth side wall 114 that oppose each other in the Y-axis direction. The outer shape of the ink tank 4*d* is substantially rectangular-parallelepiped.

A liquid injection port 120 is provided in an upper part of the ink tank 4*d*. The liquid injection port 120 is provided in a recessed portion 121, which is recessed downward from the upper wall 115. The recessed portion 121 has a bottom wall 1212, and is formed by a wall portion 1211 having a cone shape. When the user supplies the ink, the ink that has overflowed from the liquid injection port 120 is received by the recessed portion 121, and is prevented from flowing down to the lower side.

Figure 9:
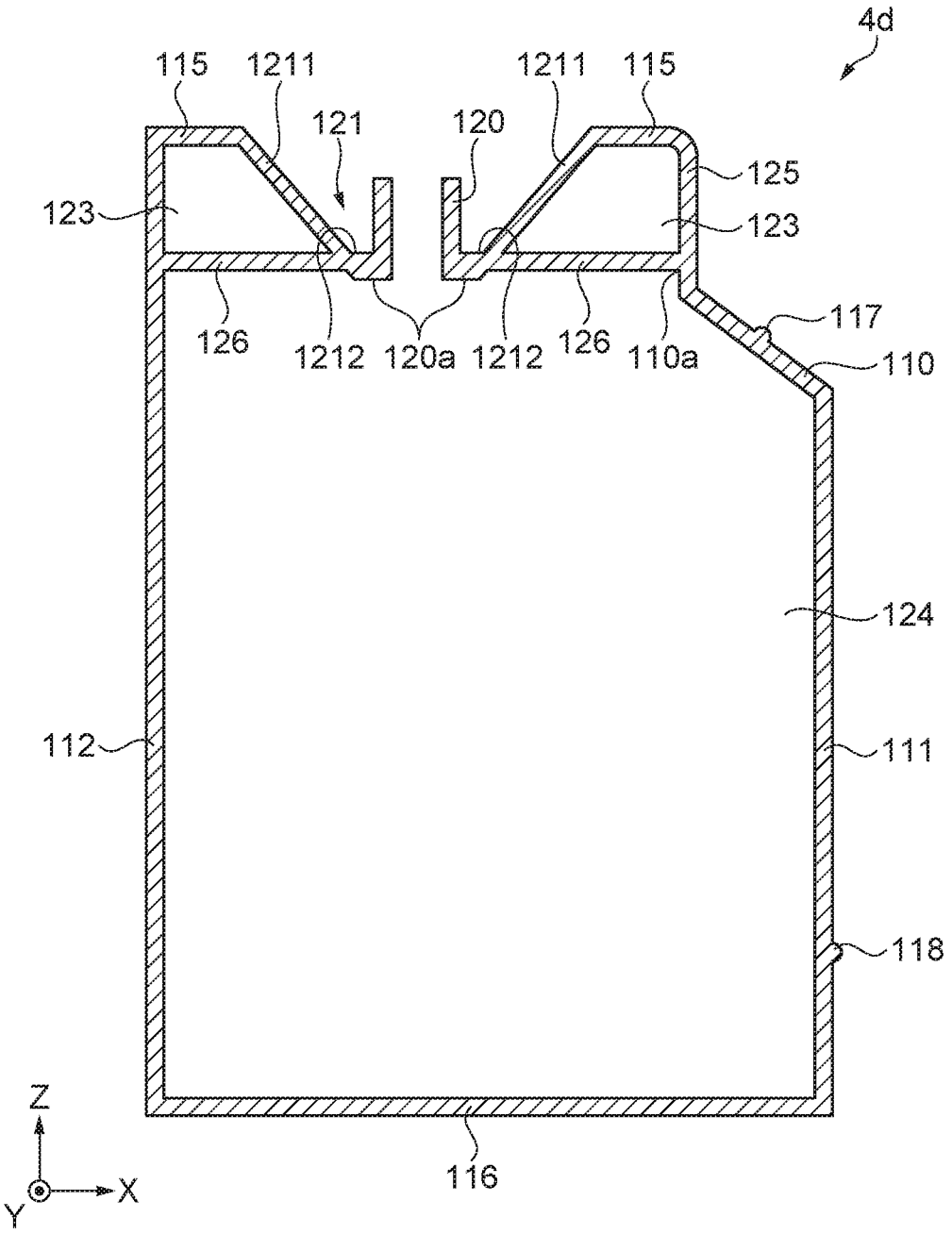
FIG. 9 is a cross-sectional view of the ink tank according to Embodiment 4.

FIG. 9 is a cross-sectional view of the ink tank 4*d* as viewed from the arrow direction at a cross-sectional position E-E' in FIG. 8. An air containing portion 123 is formed in an upper part of the ink tank 4*d*. The air containing portion 123 is a space area surrounded by wall portions including the upper wall 115, the wall portion 1211, an upper part of the second side wall 112, an upper part of the third side wall 113 and an upper part of the fourth side wall 114 in FIG. 8, a partition wall 126 in FIG. 9 that horizontally extends and partitions the space, and the like. The air containing portion 123 is in communication with an atmosphere port 119 provided in the upper wall 115 in FIG. 8, and is open to the atmosphere.

A liquid containing portion 124 is formed below the air containing portion 123 in FIG. 9. The liquid containing portion 124 is a space area surrounded by wall portions including the bottom wall 116, the first to fourth side walls 111, 112, 113, and 114, the partition wall 126, and the like. The liquid containing portion 124 is in communication with a liquid leading portion 122, which is provided in the second side wall 112 in FIG. 8. The liquid containing portion 124 is in communication with the air containing portion 123.

A wall portion 125 that extends in the Z-axis direction is formed at an end portion of the upper wall 115 in the +X-axis direction. An inclined portion 110 is provided between the wall portion 125 and the first side wall 111. The inclined portion 110 is a wall portion that inclines relative to the vertical direction (Z-axis direction). The inclined portion 110 is located on the upper side of the liquid containing portion 124, and is a part of wall portions that form an upper part of the liquid containing portion 124.

The first side wall 111 and the inclined portion 110 constitute a liquid visual check portion that is formed by translucent resin. The first side wall 111 and the inclined portion 110 are formed by translucent resin, an upper limit mark 117 is formed in the inclined portion 110, and a lower limit mark 118 is formed in a lower part of the first side wall 111.

In the vertical direction in FIG. 9, the position of an upper end portion 110*a* of the inclined portion 110 is above the position of a lower end portion 120*a* of the liquid injection port 120.

With this configuration, when the ink is injected from the liquid injection port 120, a situation where the ink is attached to an inner circumferential face of the liquid injection port 120, and the attached ink moves along the partition wall 126 and flows to the inclined face 110 side does not occur. Therefore, since the ink is not attached to the inclined portion 110, the visibility of the inclined portion 110 from the outside can be favorably maintained.

Figure 10A:
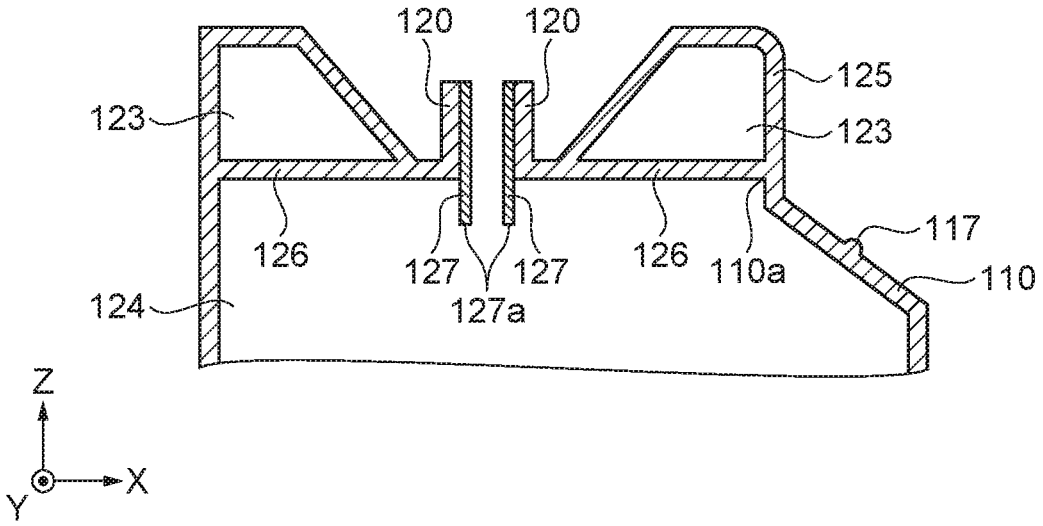
FIGS. 10A and 10B are diagrams showing a part of a lower end portion of a liquid injection port.
Figure 10B:
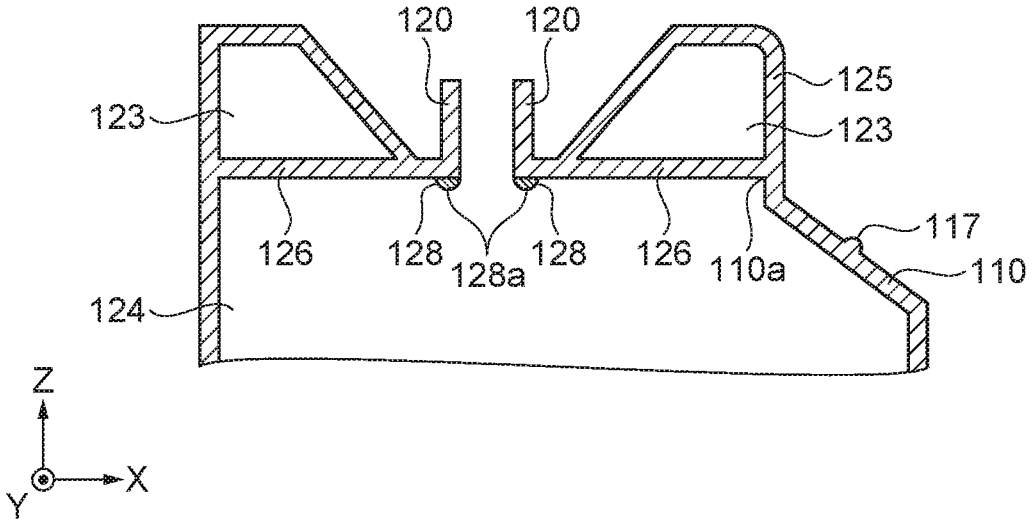

FIGS. 10A and 10B are diagrams showing a part of a lower end portion of the liquid injection port 120. A configuration may be employed in which, as shown in FIG. 10A, a cylindrical member 127 is inserted in the liquid injection port 120, and a lower end portion 127*a* of the cylindrical member 127 is located at a position below the position of the upper end portion 110*a* of the inclined portion 110.

A configuration may also be employed in which, as shown in FIG. 10B, a ring-shaped member 128 is provided at a connection portion between the liquid injection port 120 and the partition wall 126, and a lower end portion 128*a* of the ring-shaped member 128 is located at a position below the position of the upper end portion 110*a* of the inclined portion 110. Other configurations of the printer in this embodiment are the same as those described in Embodiment 1.

Embodiment 5

In a liquid visual check portion provided in an ink tank according to Embodiment 5, a wall portion that is inclined relative to the vertical direction is not formed. FIG. 11A is a perspective external view of an ink tank 150 according to Embodiment 5.

Outer wall portions of the ink tank 150 are configured to include an upper wall 155 and a bottom wall 156 that oppose each other in the Z-axis direction, a first side wall 151 and a second side wall 152 that oppose each other in the X-axis direction, and a third side wall 153 and a fourth side wall 154 that oppose each other in the Y-axis direction. The outer shape of the ink tank 150 is substantially rectangular-parallelepiped.

A liquid injection port 160 is provided in an upper part of the ink tank 150. The liquid injection port 160 is provided in a recessed portion 161, which is recessed downward from the upper wall 155. The recessed portion 161 has a bottom wall 1612, and is formed by a wall portion 1611 having a cone shape.

Figure 11B:
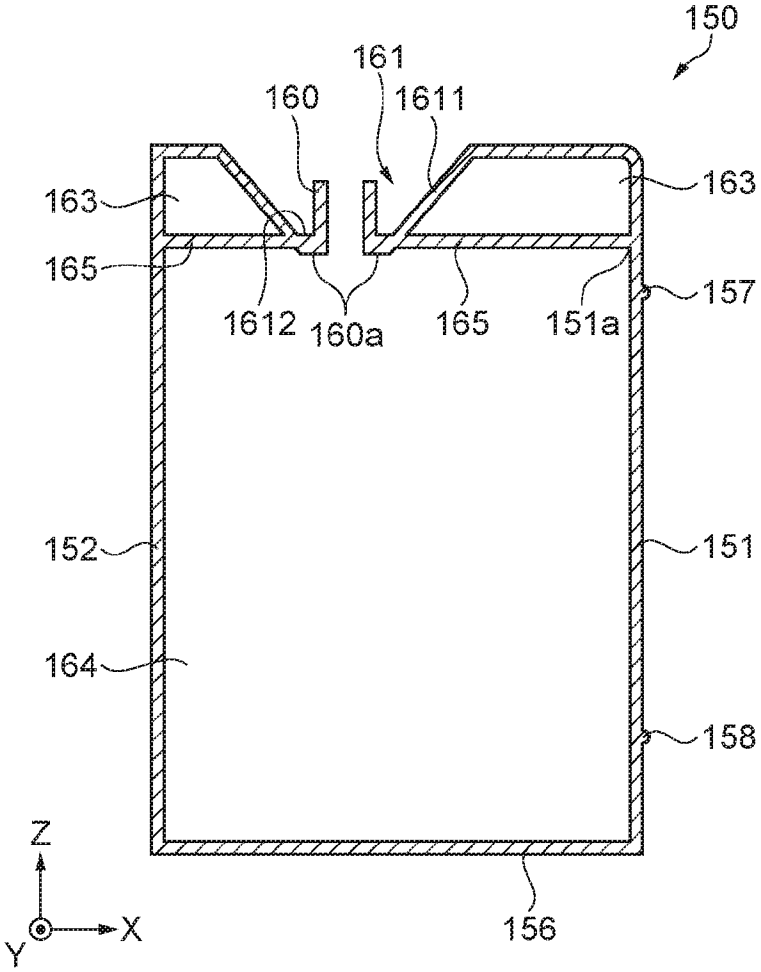
FIG. 11B is a cross-sectional view of the ink tank.
Figure 11A:
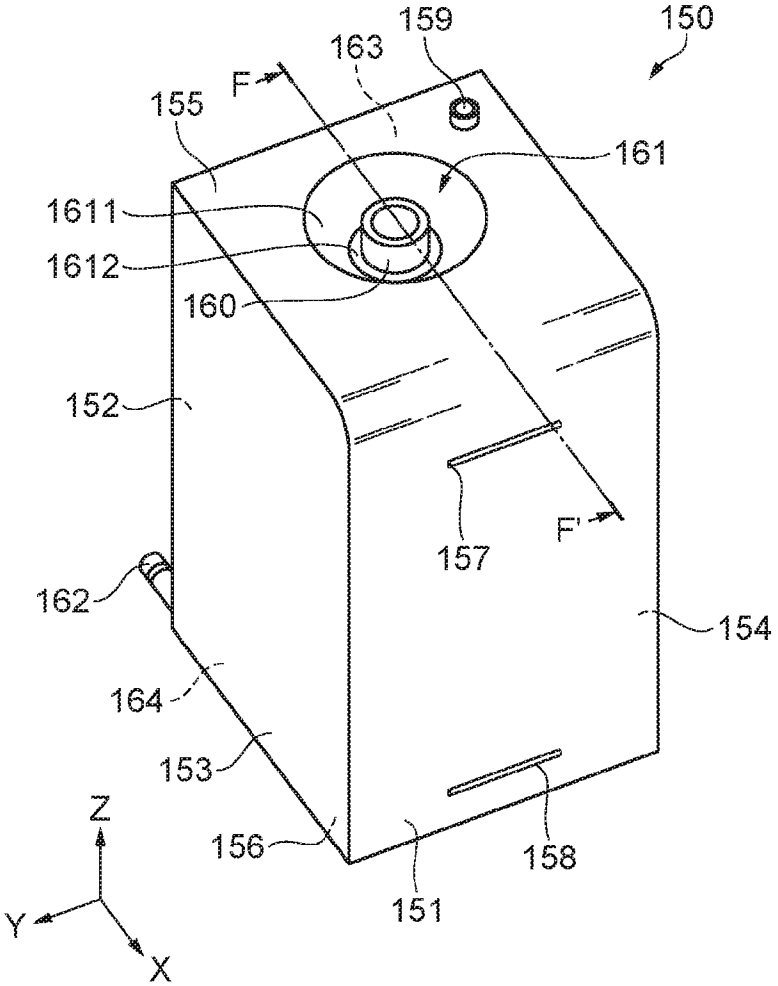
FIG. 11A is a perspective external view of an ink tank according to Embodiment 5.

FIG. 11B is a cross-sectional view of the ink tank 150 in FIG. 11A as viewed from the arrow direction at a cross-sectional position F-F'. An air containing portion 163 is formed in an upper part of the ink tank 150. The air containing portion 163 is in communication with an atmosphere port 159 in FIG. 11A that is provided in the upper wall 155, and is open to the atmosphere.

A liquid containing portion 164 is formed below the air containing portion 163. The liquid containing portion 164 is a space area surrounded by wall portions including the bottom wall 156, the first to fourth side walls 151, 152, 153, and 154, the partition wall 165 that partitions the liquid containing portion 164 and the air containing portion 163, and the like. The liquid containing portion 164 is in communication with a liquid leading portion 162, which is provided in the second side wall 152 in FIG. 11A. The liquid containing portion 164 is in communication with the air containing portion 163.

The first side wall 151 is formed by translucent resin and erected from the bottom wall 156 in the vertical direction Z, and does not incline relative to the vertical direction Z. An upper limit mark 157 and a lower limit mark 158 are formed in the first side wall 151. In this embodiment, the first side wall 151 is configured as a liquid visual check portion through which the position of the liquid surface of the ink contained in the liquid containing portion 164 can be visually checked.

In the vertical direction, the position of an upper end portion 151*a* of the first side wall 151 is above the position of a lower end portion 160*a* of the liquid injection port 160.

With this configuration, when the ink is injected from the liquid injection port 160, a situation where the ink is attached to an inner circumferential face of the liquid injection port 160, and the attached ink moves along the partition wall 165 to flow to the first side wall 151 side does not occur. Therefore, since the ink is not attached to the first side wall 151, the visibility of the first side wall 151 can be favorably maintained. Other configurations of the printer in this embodiment are the same as those described in Embodiment 1.

Figure 12:
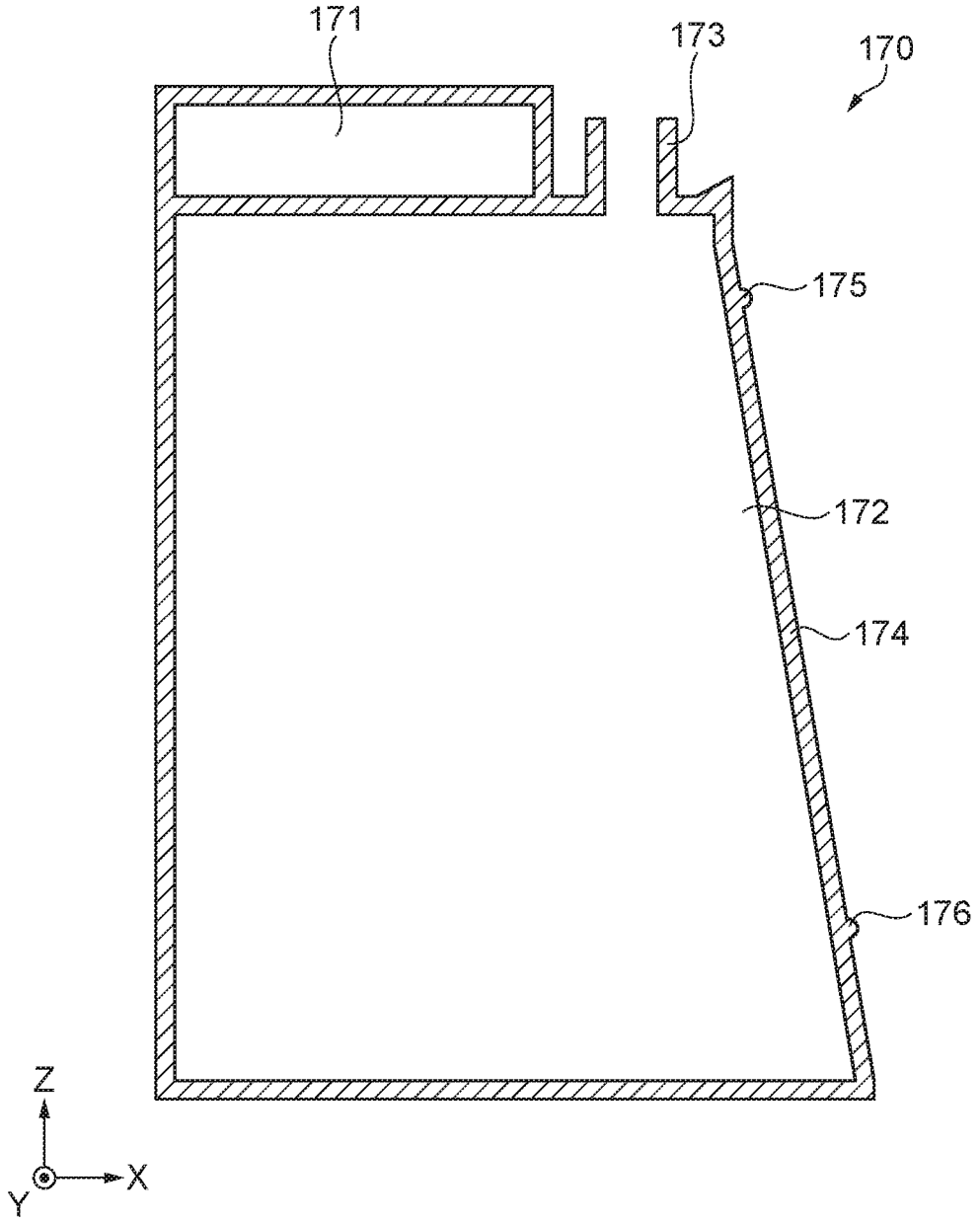
FIG. 12 is a cross-sectional view of an ink tank according to another embodiment.

The inclined portions 30, 50, 70, 90, and 110 described in Embodiments 1 to 4 each constitute a part of the liquid visual check portion. However, as shown in a cross-sectional view of an ink tank 170 in FIG. 12, an inclined portion 174 may constitute the entire liquid visual check portion.

The ink tank 170 includes an air containing portion 171, a liquid containing portion 172, and a liquid injection port 173. The inclined portion 174 inclines relative to the vertical direction, and constitutes a part of wall portions that form the liquid containing portion 172. An upper limit mark 175, which projects from a face of the inclined portion 174, is formed in an upper part of the inclined portion 174, and a lower limit mark 176 is formed in a lower part of the inclined portion 174. The inclined portion 174 constitutes the entire liquid visual check portion that is formed by translucent resin.

The liquid ejection heads 15 provided in the liquid ejection apparatuses described in Embodiments 1 to 5 move back and forth in the main scanning direction. However, the invention is also applied to a liquid ejection apparatus that includes a liquid ejection head in which a nozzle for injecting the ink is arranged over the width direction of conveyed paper and that is fixed to the apparatus body.

What is claimed is:

1. A liquid container comprising:

a wall portion that forms a liquid containing portion for containing liquid;

a liquid injection port for injecting the liquid into the liquid containing portion, the liquid injection port being provided above the liquid containing portion; and a liquid visual check portion that is translucent and through which a position of a liquid surface of the liquid can be visually checked from the outside, the liquid visual check portion being a part of the wall portion that forms the liquid containing portion, wherein the liquid visual check portion has an inclined portion that inclines relative to a vertical direction, and wherein an inclining direction of the inclined portion is a direction in which a plurality of the liquid containers are arranged side-by-side.

2. The liquid container according to claim 1, wherein a direction in which the liquid injection port and the inclined portion are arranged side-by-side as viewed from the vertical direction is an inclining direction of the inclined portion.

3. The liquid container according to claim 1, wherein a direction in which the liquid injection port and the inclined portion are arranged side-by-side as viewed from the vertical direction is a direction that intersects an inclining direction of the inclined portion.

4. The liquid container according to claim 1, wherein the inclined portion is formed in a vertically upper part of the wall portion.

5. The liquid container according to claim 1, wherein an index that can be compared with the position of the liquid surface of the liquid is formed in the inclined portion.

6. The liquid container according to claim 1, wherein in the vertical direction, a position of an upper end portion of the inclined portion is above a position of a lower end portion of the liquid injection port.

7. A liquid container comprising:

a wall portion that forms a liquid containing portion for containing liquid;

a liquid injection port for injecting the liquid into the liquid containing portion, the liquid injection port being provided above the liquid containing portion; and a liquid visual check portion that is translucent and through which a position of a liquid surface of the liquid can be visually checked from the outside, the liquid visual check portion being a part of the wall portion that forms the liquid containing portion, wherein in a vertical direction, a position of an upper end portion of the liquid visual check portion is above a position of a lower end portion of the liquid injection port.

8. A liquid container comprising:

a wall portion that forms a liquid containing portion for containing liquid;

a liquid injection port for injecting the liquid into the liquid containing portion, the liquid injection port being provided above the liquid containing portion; and a liquid visual check portion that is translucent and through which a position of a liquid surface of the liquid can be visually checked from the outside, the liquid visual check portion being a part of the wall portion that forms the liquid containing portion, wherein the liquid visual check portion has an inclined portion that inclines relative to a vertical direction, and wherein an inclining direction of the inclined portion is a direction that intersects a direction in which a plurality of the liquid containers are arranged side-by-side.

9. The liquid container according to claim 8, wherein a direction in which the liquid injection port and the inclined portion are arranged side-by-side as viewed from the vertical direction is an inclining direction of the inclined portion.

10. The liquid container according to claim 8, wherein a direction in which the liquid injection port and the inclined portion are arranged side-by-side as viewed from the vertical direction is a direction that intersects an inclining direction of the inclined portion.

11. The liquid container according to claim 8, wherein the inclined portion is formed in a vertically upper part of the wall portion.

12. The liquid container according to claim 8, wherein an index that can be compared with the position of the liquid surface of the liquid is formed in the inclined portion.

13. The liquid container according to claim 8, wherein in the vertical direction, a position of an upper end portion of the inclined portion is above a position of a lower end portion of the liquid injection port.

14. A liquid container comprising:

a wall portion that forms a liquid containing portion for containing liquid;

a liquid injection port for injecting the liquid into the liquid containing portion, the liquid injection port being provided above the liquid containing portion; and a liquid visual check portion that is translucent and through which a position of a liquid surface of the liquid can be visually checked from the outside, the liquid visual check portion being a part of the wall portion that forms the liquid containing portion, wherein the liquid visual check portion has an inclined portion that inclines relative to a vertical direction, and wherein an inclining direction of the inclined portion is a direction that intersects a direction in which a plurality of the liquid containing portions are arranged side-by-side.

15. The liquid container according to claim 14, wherein a direction in which the liquid injection port and the inclined portion are arranged side-by-side as viewed from the vertical direction is an inclining direction of the inclined portion.

16. The liquid container according to claim 14, wherein a direction in which the liquid injection port and the inclined portion are arranged side-by-side as viewed from the vertical direction is a direction that intersects an inclining direction of the inclined portion.

17. The liquid container according to claim 14, wherein the inclined portion is formed in a vertically upper part of the wall portion.

18. The liquid container according to claim 14, wherein an index that can be compared with the position of the liquid surface of the liquid is formed in the inclined portion.

19. The liquid container according to claim 14, wherein in the vertical direction, a position of an upper end portion of the inclined portion is above a position of a lower end portion of the liquid injection port.

* * * * *